US005855199A

United States Patent [19]

McLeod

[11] Patent Number: 5,855,199

[45] Date of Patent: Jan. 5, 1999

[54] DISCHARGE IGNITION APPARATUS FOR INTERNAL COMBUSTION ENGINE HAVING SHUT-OFF FEATURE

[75] Inventor: Paul W. McLeod, Warrenville, S.C.

[73] Assignee: R.E. Phelon Co., Inc., Aiken, S.C.

[21] Appl. No.: 882,359

[22] Filed: Jun. 25, 1997

[51] Int. Cl.[6] ..... F02P 11/00; F02B 77/08

[52] U.S. Cl. ..... 123/599; 123/198 DC; 123/630

[58] Field of Search ..... 123/149 A, 149 D, 123/198 D, 198 DC, 599, 630

[56] References Cited

U.S. PATENT DOCUMENTS

| | | | |
|---|---|---|---|
| 3,500,809 | 3/1970 | Hohne et al. | 123/599 X |
| 4,073,279 | 2/1978 | Fox | 123/198 DC |
| 4,193,385 | 3/1980 | Katsumata et al. | 123/198 DC |
| 4,976,234 | 12/1990 | Okuda | 123/198 DC |
| 5,076,250 | 12/1991 | Sasaki et al. | 123/630 |
| 5,190,019 | 3/1993 | Harvey | 123/630 |

*Primary Examiner*—Tony M. Argenbright
*Attorney, Agent, or Firm*—Dority & Manning, P.A.

[57] ABSTRACT

An improved capacitive discharge ignition apparatus includes disable circuitry for permitting shut-off of the engine. The disable circuitry includes a SCR and a transistor in series to provide a bypass for current that would otherwise charge the ignition capacitor. The SCR is gated by a RC circuit charged by momentary contact of a user-actuated switch. The transistor is rendered conductive only during periods when a positive voltage is induced on the charge coil, thereby limiting discharge of the RC circuit. In addition, the RC circuit is regeneratively charged by a leakage current through the SCR gate. The disable circuitry thus achieves engine stoppage regardless of the time required.

20 Claims, 4 Drawing Sheets

V
$V_c$
58 t
56
60
$V_p$
62
66 t
64
$V_{cap}$
68 t
V

DISCHARGE IGNITION APPARATUS FOR INTERNAL COMBUSTION ENGINE HAVING SHUT-OFF FEATURE

BACKGROUND OF THE INVENTION

The present invention generally relates to an improved ignition system for use in an internal combustion engine. More particularly, the invention relates to a discharge ignition apparatus configured to permit engine shut off.

It is often desirable to provide a "kill switch" to disable the ignition of a small gasoline engine. In many designs, an ignition switch is provided that remains in either an "On" position or "Off" position until changed by the user. Thus, the user is required to ensure that the switch is in the "On" position before the engine can be restarted.

In other designs, a momentary contact switch is provided to disable operation of the engine. In this case, the user will typically depress the "kill switch" while the engine is running. Even if the contact switch is subsequently released, holding circuitry may be provided to continue the ignition disable until the engine comes to rest. An example of this type of system is described in U.S. Pat. No. 4,193,385 to Katsumata, incorporated herein by reference.

The present invention is directed to novel ignition arrangements including a shut off feature.

SUMMARY OF THE INVENTION

In one aspect, the present invention provides an ignition apparatus for use with an internal combustion engine to produce an electrical spark at a spark ignition device. The apparatus comprises a magnet assembly, including a pair of pole faces, operatively revolved along a circular path. A magnetically permeable core is mounted adjacent to the circular path and has at least two leg portions each including a respective end face. The leg portions are situated such that the pole faces pass proximate to the end faces during revolution of the magnet assembly. As a result, a magnetic flux is produced in the magnetically permeable core.

The ignition apparatus further includes a transformer having a primary coil and a secondary coil related by a predetermined step-up ratio. The secondary coil is electrically connected during operation to the spark ignition device. Spark generation circuitry is also provided for applying a primary voltage pulse to the primary coil responsive to a triggering signal. The primary voltage pulse in turn produces a spark generating pulse in the secondary coil.

The ignition apparatus also includes disable circuitry operative to inhibit the spark generating pulse by providing a bypass upon actuation of a user-actuated switch. The disable circuitry includes holding circuitry to continue the bypass even if the user-actuated switch is released. A selectively conducting element is also provided to inhibit discharge of the holding circuitry except at predetermined times.

In some exemplary embodiments, the holding circuitry comprises a capacitive element connected to be charged upon actuation of the user-actuated switch. A SCR device may be connected in series with the selectively conducting element, with the capacitor operatively connected to a gate of the SCR device. Preferably, a resistive element may be electrically connected between the capacitive element and the SCR gate.

Often, the selectively conducting element may be a transistor. In such cases, the disable circuitry may further include a voltage divider network operative to bias the transistor for conduction at the predetermined times.

In some exemplary embodiments, the spark generation circuitry and the disable circuitry each include a SCR device electrically connected in circuit. For example, the spark generation circuitry may include a first SCR device and the disable circuitry may include a second SCR device. Preferably, the spark generation circuitry is electrically connected to derive the triggering signal from voltage induced across the primary coil.

Another aspect of the present invention involves a discharge circuit for use in a discharge ignition system of the type operative to produce an electrical spark at a spark ignition device. The discharge circuit comprises a storage capacitor, a charge coil and a rectifier electrically connected therebetween. A transformer is also provided, including a primary coil and a secondary coil. The secondary coil is electrically connected during operation to the spark ignition device to produce the electrical spark.

The discharge circuit further includes triggering circuitry having a first electronic switch electrically connected in circuit with the storage capacitor and the primary coil. The triggering circuitry is operative to apply a triggering signal derived from a voltage induced across the primary coil to a triggering node of the first electronic switch.

Disable circuitry, including a second electronic switch, operatively provides a bypass therethrough, upon actuation of a user-actuated switch, to prevent substantial charging of the storage capacitor. The disable circuitry includes holding circuitry to continue the bypass even if the user-actuated switch is released.

In some exemplary embodiments, the disable circuitry further includes a selectively conducting element electrically connected in series with the second electronic switch to inhibit discharge of the holding circuitry except at predetermined times. For example, the selectively conducting element may comprise a transistor. In such embodiments, the voltage divider network is operative to bias the transistor for conduction at the predetermined times. In addition, the holding circuitry may comprise a capacitive element and a resistive element forming an RC circuit electrically connected to the second electronic switch.

Often, the triggering circuitry may include a voltage divider network electrically connected across the primary coil to derive the triggering signal at a divider node thereof. Moreover, the first electronic switch and the second electronic switch may be separate circuit components. For example, the first electronic switch and the second electronic switch may be separate SCR devices.

In another aspect, the present invention provides a discharge ignition apparatus for use with an internal combustion engine to produce an electrical spark at a spark ignition device. The apparatus comprises a movable magnet assembly including a pair of pole faces. A magnetically permeable core is also provided, having at least two leg portions each including a respective end face. The magnetically permeable core is mounted such that the pole faces pass proximate to the end faces as the magnet assembly is operatively moved to produce a magnetic flux in the magnetically permeable core. A transformer of the discharge ignition apparatus includes a primary coil, and a secondary coil electrically connected during operation to the spark ignition device.

The discharge ignition apparatus also includes a discharge circuit having an energy storage element and a charge coil. A charging voltage is induced on the charge coil by the magnetic flux to supply charging energy to the energy storage element. A first electronic switch is electrically connected in circuit with the energy storage element and the primary coil. Activation of the first electronic switch during operation by triggering circuitry produces a voltage on the primary coil.

The discharge circuit also includes disable circuitry having a second electronic switch. The disable circuitry operatively provides a bypass therethrough upon actuation of a user-actuated switch to prevent substantial charging of the energy storage element. In addition, holding circuitry is provided to continue the bypass even if the user-actuated switch is released. A selectively conducting element electrically connected in series with the second electronic switch inhibits discharge of the holding circuitry except at predetermined times.

In some exemplary embodiments, the selectively conducting element comprises a transistor. In such cases, the disable circuitry may further include a voltage divider network operative to bias the transistor for conduction at the predetermined times. In addition, the holding circuitry may comprises a capacitive element and a resistive element forming an RC circuit electrically connected to the second electronic switch.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
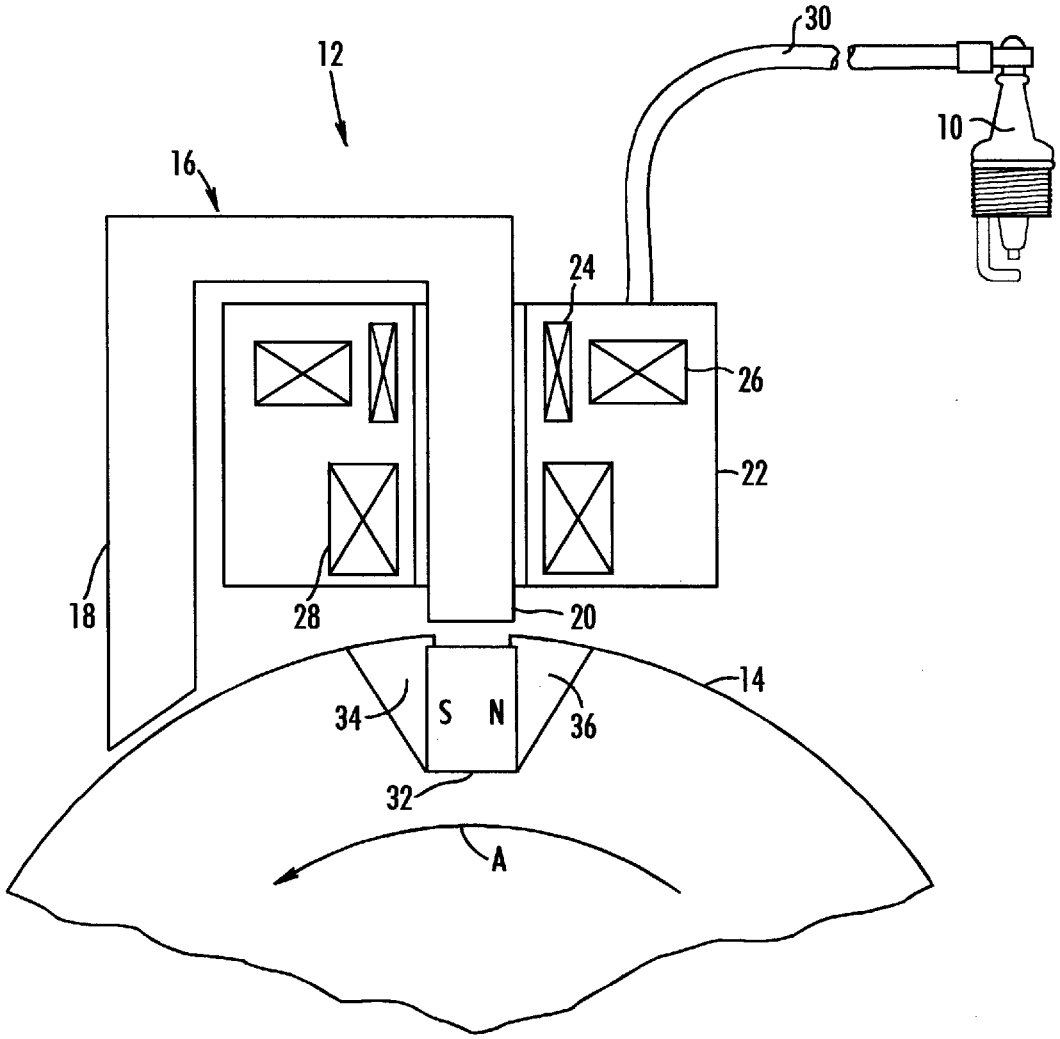
FIG. 1 is an elevational view of various components in a discharge ignition system such as may be constructed according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates a discharge ignition apparatus constructed in accordance with the present invention. The apparatus is configured to produce the requisite spark at spark plug 10 to ignite the air-fuel mixture within the piston cylinder of the engine. The apparatus may be used with various devices powered by gasoline engines, particularly smaller two-cycle gasoline engines.

Generally, the apparatus includes a stator unit 12 and a rotatable flywheel 14. Flywheel 14 typically includes a central bore for mounting to a rotatable spindle mechanically interconnected with the engine's drive shaft. As a result, rotation of the spindle will produce a concomitant rotation of flywheel 14 (such as in the direction indicated by arrow A).

Stator unit 12, which typically remains fixed with respect to the engine during use, includes a magnetically permeable core 16. In this case, core 16 includes two depending leg portions, respectively indicated at 18 and 20. In many embodiments, however, the magnetically permeable core may be constructed having more than two such leg portions.

A sealed housing 22 maintains the various coils and other components utilized to produce a spark at spark plug 10. In particular, housing 22 includes a transformer having a primary coil 24 and a secondary coil 26. In the illustrated embodiment, coils 24 and 26 may be mounted coaxially about leg portion 20. A charge coil 28, which may also be mounted about leg portion 20, provides a source of energy for the ignition spark as will be explained more fully below. The various components within housing 22 may be protected and maintained securely in position via a suitable potting compound. Electrical connection with spark plug 10 is achieved by a typical interconnecting wire 30.

A magnet assembly is mounted adjacent the periphery of flywheel 14 to revolve about a circular path in synchronism with operation of the engine. The magnet assembly includes a permanent magnet 32 having pole pieces 34 and 36 mounted at respective ends thereof. It will be appreciated that the circumferential faces of pole pieces 34 and 36 will pass proximate to the end faces of leg portions 18 and 20 as flywheel 14 is rotated. As a result, magnetic flux is produced within core 16, as desired.

Figure 2:
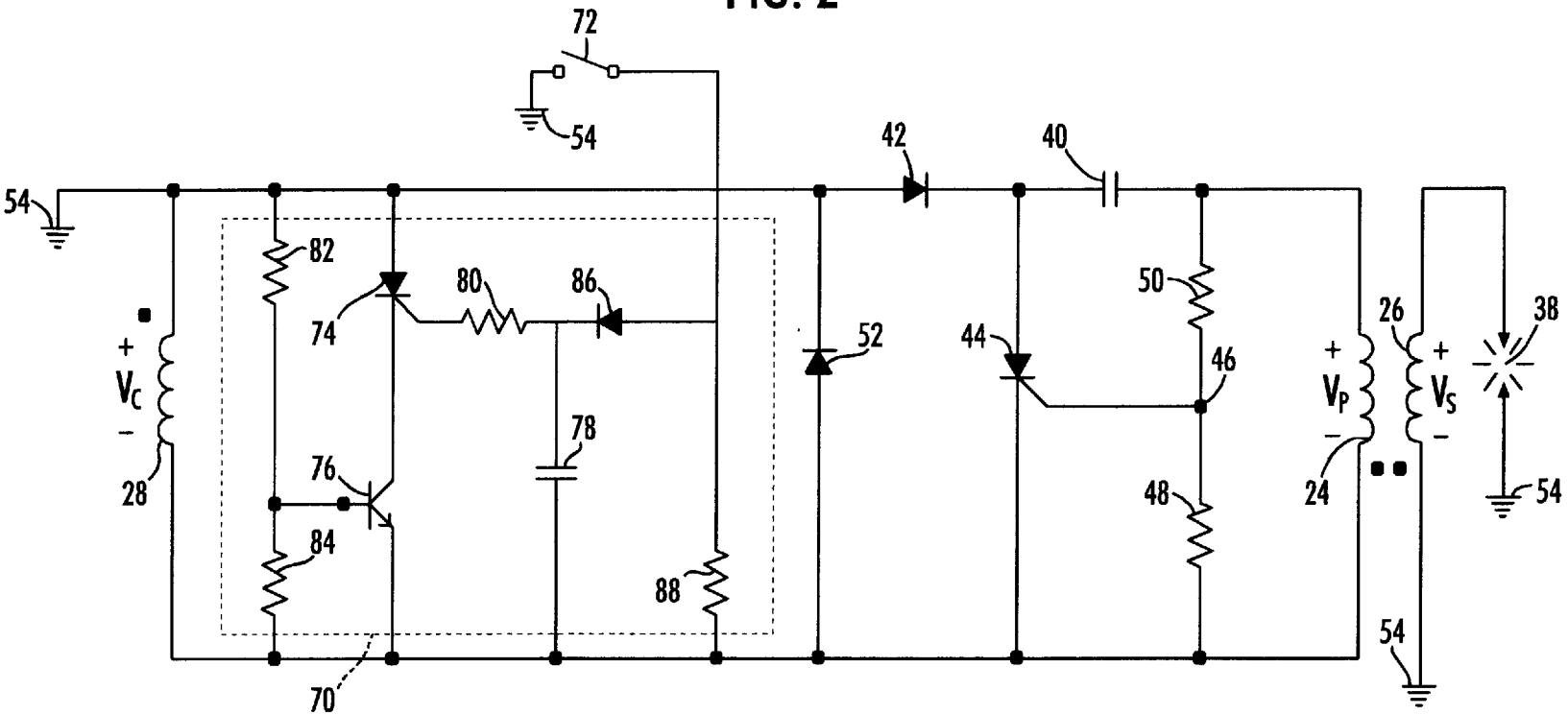
FIG. 2 is a schematic diagram illustrating an exemplary electronic ignition circuit constructed according to the present invention.

The various electronic components contained within sealed housing 22 of stator unit 12 may be most easily understood with reference to the schematic circuit diagram of FIG. 2. As can be seen, secondary coil 26 is connected across the gap 38 of spark plug 10. Charge coil 28 is electrically connected to a storage capacitor 40 through a rectifier diode 42. Capacitor 40 is, in turn, electrically connected in circuit with primary coil 24 through SCR 44.

SCR 44 is rendered conductive by a triggering signal supplied to triggering node 46, which is the SCR gate. Preferably, the triggering signal may be derived from the voltage induced across the primary coil. For example, one terminal of the primary coil may be connected to the SCR gate through a single current limiting resistor.

In other cases, such as the illustrated embodiment, the triggering signal is produced by a voltage divider network including resistors 48 and 50. This technique is advantageous to ensure that the triggering signal occurs at a predetermined point on the primary coil voltage curve. For example, the triggering signal may be set to occur at a time when a sustaining potential is being otherwise induced on the secondary coil. As a result, a spark initiated by capacitor discharge can be maintained for a longer duration without the use of a larger discharge capacitor.

Diode 52 functions as a ringback diode for reversal of the polarity of capacitor 40 during discharge. A relative ground, as indicated at 54, typically provides electrical communication with the engine block.

The operation of the circuit shown in FIG. 2 will now be explained with reference to the waveforms illustrated in FIGS. 3A through 3C. The illustrated waveforms are merely diagrammatic in nature for which scale is not implied. In addition, one skilled in the art will recognize that references to "positive" or "negative" are merely a matter of convention. It will also be appreciated that the illustrated sequence is repeated for every revolution of the magnet assembly.

Figures 3A, 3B, 3C:
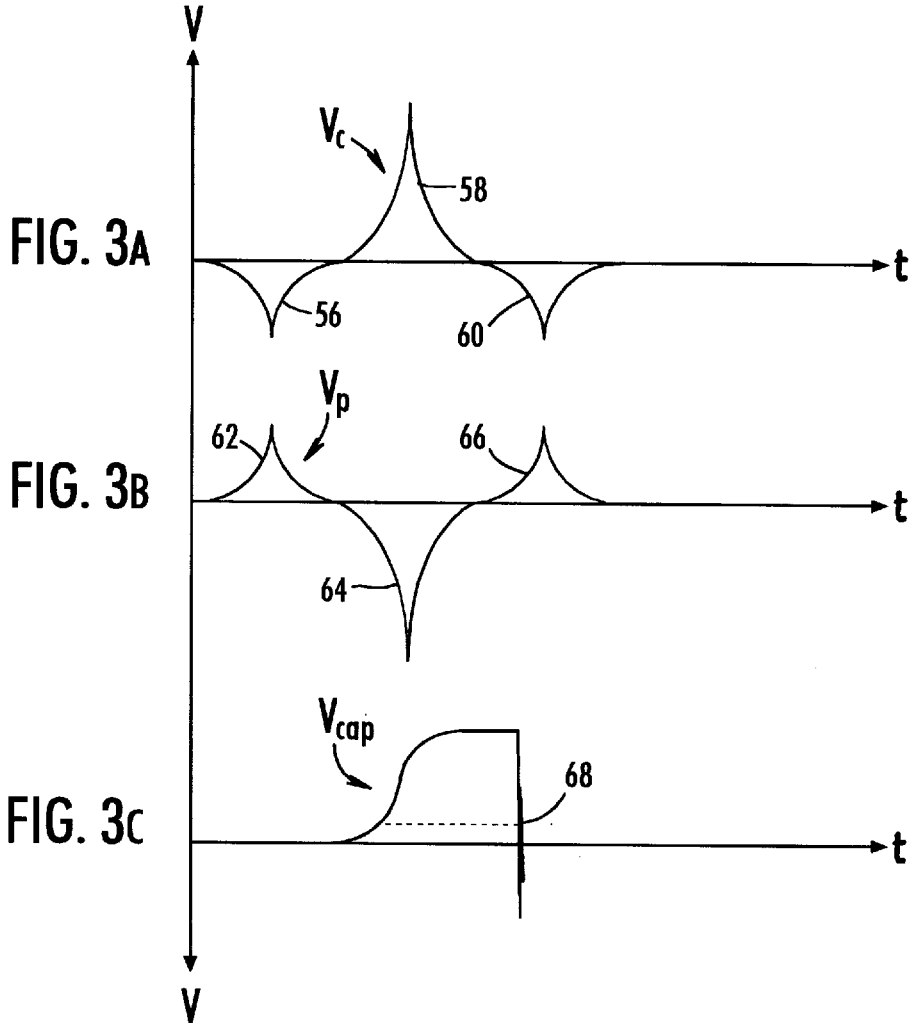
FIGS. 3A through 3C diagrammatically illustrate various voltage plots taken at respective locations in the circuit of FIG. 2.

FIG. 3A illustrates a waveform $V_c$ of the voltage produced across charge coil 28 during one passage of the magnet assembly carried by flywheel 14. As can be seen, waveform $V_c$ includes a first negative excursion 56 followed by a relatively large positive excursion 58. Typically, capacitor 40 will be charged during positive excursion 58, and assume a value near the peak voltage reached during the excursion. A second negative excursion 60 follows positive excursion 58.

FIG. 3B illustrates a waveform $V_p$ such as may be induced across primary coil 24 at corresponding points in time. The voltage waveform induced across secondary coil 26 will have a similar shape, although the magnitude will be larger due to the greater number of turns at this winding. As can be seen, waveform $V_p$ exhibits a positive excursion 62 followed by a negative excursion 64. Negative excursion 64 is then followed by a positive excursion 66.

While positive excursion 62 applies a triggering signal to the gate of SCR 44, capacitor 40 has not yet been charged. At the beginning of positive excursion 66, however, capacitor 40 has been charged and is ready to discharge through primary coil 24. This can be seen in FIG. 3C, where the voltage $V_{cap}$ builds up before discharging when the triggering signal is applied. The voltage across capacitor 40 oscillates during discharge as indicated at 68.

As shown in FIG. 2, the ignition apparatus further includes disable circuitry (collectively indicated at 70) for permitting a user to shut-off the engine when desired. In particular, disable circuitry 70 provides, responsive to actuation of switch 72, a bypass for current that would otherwise charge capacitor 40. Since capacitor 40 will not be substantially charged, a spark-producing voltage will not be generated across secondary coil 26. Preferably, switch 72 may be a contact switch urged into a normally open state such as by an appropriate spring bias mechanism.

In the illustrated embodiment, the bypass current path includes a second SCR 74 having a transistor 76 connected in series therewith. The gate of SCR 74 is connected to an RC network including capacitor 78 and resistor 80. The base of transistor 76 is electrically connected to the node between resistors 82 and 84.

Disable circuitry 70 further includes a diode 86 and a resistor 88 connected across capacitor 78. As shown, one terminal of switch 72 is connected to ground 54. The other terminal of switch 72 is connected to the node between diode 86 and resistor 88.

Figure 2B:
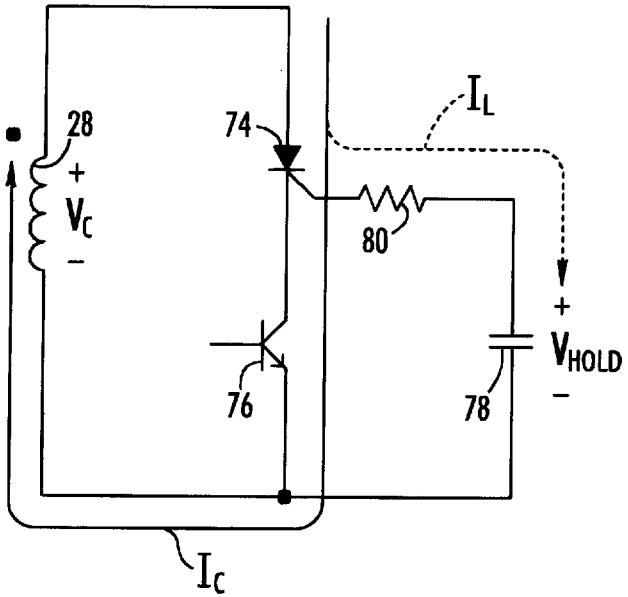
FIGS. 2A and 2B are partial schematics illustrating aspects of the engine shut-off feature in the circuit of FIG. 2.
Figure 2A:
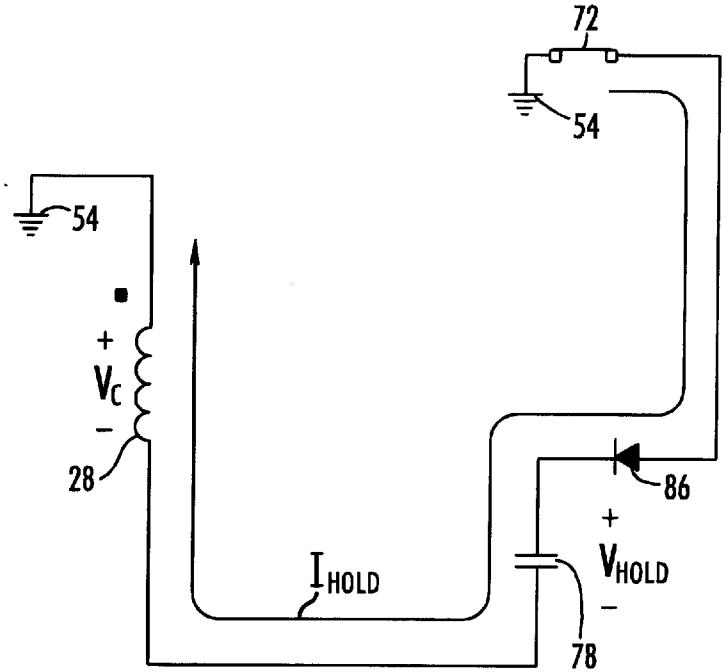

Referring now also to FIG. 2A, engine shut-off is initiated when a user cause a momentarily contact of switch 72. As a result, capacitor 78 is quickly charged through diode 86 by virtue of the charging current $I_{HOLD}$ produced from the voltage $V_c$ induced on charge coil 28. The voltage $V_{HOLD}$ thus accumulating on capacitor 78 gates SCR 74 through resistor 80. In addition, transistor 76 is biased on each cycle by the resistive voltage divider on its base. As shown in FIG. 2B, the serial combination of SCR 74 and transistor 76 thus establishes a bypass path for the current $I_c$ that would otherwise charge capacitor 40.

Between cycles, transistor 76 turns off in the absence of a base voltage, thereby preventing capacitor 78 from further discharging. Without transistor 76, capacitor 78 would continue between cycles to discharge through the gate-cathode junction of SCR 74. Also, the voltage drop across transistor 76 (typically less than about 15V) when it is conducting allows a reverse leakage current $I_L$ from the gate of SCR 74 to recharge capacitor 78.

The regenerative action of current $I_L$, and the operation of transistor 76, allows capacitor 78 to be relatively small and still maintain the shut-off mode until the engine comes to rest, regardless of the time required. For example, a capacitor value of less than 1 $\mu$F, preferably less than 0.1 $\mu$F, may be appropriate in many embodiments of the invention. Without transistor 76, several orders of magnitude greater capacitance would be required to supply sufficient gating current to achieve shut-off. When the engine comes to rest, capacitor 78 fully discharges and the circuit is reset. Thus, the operator need not reset a switch before restarting the engine.

While preferred embodiments of the invention have been shown and described, modifications and variations be made thereto by those of ordinary skill in the art without departing from the spirit and scope of the present invention. For example, it may be desirable in some circuit arrangements to substitute an inductor or other circuit component as the energy storage element. In addition, it should be understood that aspects of various embodiments of the invention may be interchanged both in whole or in part. Furthermore, those of ordinary skill in the art will appreciate that the foregoing description is by way of example only, and is not intended to be limitative of the invention so further described in the appended claims.

What is claimed is:

1. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a magnetic flux in said magnetically permeable core;

a transformer having a primary coil and a secondary coil related by a predetermined step-up ratio, said secondary coil electrically connected during operation to the spark ignition device;

spark generation circuitry operative to apply a primary voltage pulse to said primary coil responsive to a triggering signal, said primary voltage pulse producing a spark generating pulse in said secondary coil; and disable circuitry operative to inhibit said spark generating pulse by providing a bypass upon actuation of a user-actuated switch, said disable circuitry including holding circuitry to continue said bypass even if said user-actuated switch is released and further including a selectively conducting element to inhibit discharge of said holding circuitry except at predetermined times.

2. An ignition apparatus as set forth in claim 1, wherein said holding circuitry comprises a capacitive element connected to be charged upon actuation of said user-actuated switch.

3. An ignition apparatus as set forth in claim 2, wherein said disable circuitry includes a SCR device connected in series with said selectively conducting element, said capacitor operatively connected to a gate of said SCR device.

4. An ignition apparatus as set forth in claim 3, further including a resistive element electrically connected between said capacitive element and said gate of said SCR.

5. An ignition apparatus as set forth in claim 3, wherein said selectively conducting element comprises a transistor.

6. An ignition apparatus as set forth in claim 5, wherein said disable circuitry further includes a voltage divider network operative to bias said transistor for conduction at said predetermined times.

7. An ignition apparatus as set forth in claim 1, wherein said spark generation circuitry and said disable circuitry each include a SCR device electrically connected in circuit.

8. An ignition apparatus as set forth in claim 7, wherein said spark generation circuitry includes a first SCR device and said disable circuitry includes a second SCR device.

9. An ignition apparatus as set forth in claim 7, wherein said spark generation circuitry is electrically connected to derive said triggering signal from voltage induced across said primary coil.

10. A discharge circuit for use in a discharge ignition system of the type operative to produce an electrical spark at a spark ignition device, said discharge circuit comprising:

(a) a storage capacitor;

(b) a charge coil;

(c) a rectifier electrically connected between said charge coil and said storage capacitor;

(d) a transformer including a primary coil and a secondary coil, said secondary coil electrically connected during operation to the spark ignition device to produce the electrical spark;

(e) triggering circuitry including a first electronic switch electrically connected in circuit with said storage capacitor and said primary coil, said triggering circuitry operative to apply a triggering signal derived from a voltage induced across said primary coil to a triggering node of said first electronic switch; and (f) disable circuitry including a second electronic switch and operatively providing a bypass therethrough upon actuation of a user-actuated switch to prevent substantial charging of said storage capacitor, said disable circuitry including holding circuitry to continue said bypass even if said user-actuated switch is released and further including a selectively conducting element electrically connected in series with said second electronic switch to inhibit discharge of said holding circuitry except at predetermined times.

11. A discharge circuit as set forth in claim 10, wherein said selectively conducting element comprises a transistor.

12. A discharge circuit as set forth in claim 11, wherein said disable circuitry further includes a voltage divider network operative to bias said transistor for conduction at said predetermined times.

13. A discharge circuit as set forth in claim 10, wherein said holding circuitry comprises a capacitive element and a resistive element forming an RC circuit electrically connected to said second electronic switch.

14. A discharge circuit as set forth in claim 10, wherein said triggering circuitry includes a voltage divider network electrically connected across said primary coil to derive said triggering signal at a divider node thereof.

15. A discharge circuit as set forth in claim 14, wherein said first electronic switch and said second electronic switch are separate circuit components.

16. A discharge circuit as set forth in claim 15, wherein said first electronic switch and said second electronic switch are separate SCR devices.

17. A discharge ignition apparatus for use with an internal combustion engine to produce an electrical spark at a spark ignition device, said apparatus comprising:

a movable magnet assembly, said magnet assembly including a pair of pole faces;

a magnetically permeable core having at least two leg portions each including a respective end face, said magnetically permeable core being mounted such that said pole faces pass proximate to said end faces as said magnet assembly is operatively moved to produce a magnetic flux in said magnetically permeable core;

a transformer having a primary coil and a secondary coil, said secondary coil electrically connected during operation to the spark ignition device; and a discharge circuit including:

(a) an energy storage element;

(b) a charge coil having a charging voltage induced thereon by said magnetic flux to supply charging energy to said energy storage element;

(c) a first electronic switch electrically connected in circuit with said energy storage element and said primary coil, activation of said first electronic switch during operation producing a voltage on said primary coil;

(d) triggering circuitry operative to activate said first electronic switch; and (e) disable circuitry including a second electronic switch and operatively providing a bypass therethrough upon actuation of a user-actuated switch to prevent substantial charging of said energy storage element, said disable circuitry including holding circuitry to continue said bypass even if said user-actuated switch is released and further including a selectively conducting element electrically connected in series with said second electronic switch to inhibit discharge of said holding circuitry except at predetermined times.

18. A discharge ignition apparatus as set forth in claim 17, wherein said selectively conducting element comprises a transistor.

19. A discharge ignition apparatus as set forth in claim 17, wherein said disable circuitry further includes a voltage divider network operative to bias said transistor for conduction at said predetermined times.

20. A discharge ignition apparatus as set forth in claim 19, wherein said holding circuitry comprises a capacitive element and a resistive element forming an RC circuit electrically connected to said second electronic switch.

* * * * *